United States Patent [19]

Warren

[11] Patent Number: 4,992,040

[45] Date of Patent: Feb. 12, 1991

[54] AIRFLOW SWITCH CHECKING CIRCUIT

[75] Inventor: James S. Warren, Brooklyn Park, Minn.

[73] Assignee: Honeywell Inc., Minneapolis, Minn.

[21] Appl. No.: 495,672

[22] Filed: Mar. 19, 1990

[51] Int. Cl.[5] ..... F23H 5/00

[52] U.S. Cl. ..... 431/31; 431/90

[58] Field of Search ..... 431/31, 30, 90

[56] References Cited

U.S. PATENT DOCUMENTS 4,243,372 1/1981 Cade ..... 431/31

4,842,510 6/1989 Grunden et al. ..... 431/31

*Primary Examiner*—Carroll B. Dority

*Attorney, Agent, or Firm*—Edward Schwarz

[57] ABSTRACT

A burner system has a control system which operates to prevent startup of the burner if an airflow switch indicates presence of combustion air flow before startup of a blower which provides the air flow. If the airflow switch later indicates absence of air flow before startup, then startup can proceed normally without operator intervention. Power for startup is supplied through the normally closed contacts of a safety relay. The winding of the safety relay receives power through the airflow switch. When the airflow switch is closed the safety relay winding is energized, opening the normally closed safety relay contacts and thereby blocking burner system startup, but only unit the airflow switch opens.

11 Claims, 1 Drawing Sheet

AIRFLOW SWITCH CHECKING CIRCUIT

BACKGROUND OF THE INVENTION

Typical larger burner systems have a combustion air duct through which air is drawn to a combustion chamber by an electrically powered blower. The combustion chamber houses a fuel injector or nozzle which provides fuel to the chamber from a source such as a tank or a gas main. Flow of fuel to the combustion chamber is controlled by an electrically operated fuel valve which is in turn opened and closed responsive to a control signal. The fuel is typically ignited by an igniter which also receives its own control signal. A control system provides the control signals to the valve and the igniter and other elements of the system as well according to a prearranged operation sequence which schedules the order and time of each activity in the burner system. The schedule is established in the factory either by the setting of timer elements or if the controller is microprocessor-based, by factory installed software. A demand switch which controls an input to the control system starts the operation sequence when it closes. Typically, the demand switch is a thermostat which either directly controls current flow to the burner system, or actuates the winding of a relay whose contacts control the current flow.

It is necessary for safety that ignition not be attempted until the combustion chamber has been purged of any residual combustible gasses. To accomplish this, the control system in following the operation sequence first of all starts the blower and allows it to run for a period of time sufficient to assure a number of air changes within the combustion chamber and eliminate the possibility of these residual gasses.

Because of the importance of adequate purging before ignition is attempted it is now the practice to insert an airflow switch to sense flow of air in the combustion air duct. The airflow switch in one embodiment is actuated by the differential pressure created by the moving air stream. Another type of switch is nothing more than a simple normally open ON-OFF switch connected to a small sail which in response to the pressure of moving air causes the airflow switch to close. The only test which most systems currently in use now make as to proper function of the airflow switch is that the switch is closed during purging and running. Other systems sense whether the airflow switch is closed at the time the demand switch is closed, and if so aborts the startup sequence. These systems treat a malfunction resulting in such an aborted startup as one requiring an operator to intervene.

Because of the importance of proper air flow, those responsible for safe design of burner systems are now coming to the conclusion that it is important to sense that the airflow switch is open each time when the operating sequence is initiated, and that it closes at an instant shortly after the start of the operating sequence. While normally these switches are quite reliable, it is possible that defective installation or maintenance may leave the airflow switch permanently closed. Those systems which sense only that the airflow switch is closed after the startup sequence is initiated cannot sense such a condition. The most recent system designs resolve this problem by completely shutting down the startup sequence and requiring manual intervention to reset the system for another startup sequence. There is however, one situation can arise where manual intervention is unnecessary. This is where airflow switch failures are only temporary, and the switch will after a few seconds function properly again.

Such a "failure" arises when there is a power outage. A power outage removes power from the fuel valve because the designs of these valves are always such that when power is removed, the valve will close and combustion will cease immediately. Because the demand switch will still be closed, the startup sequence will be immediately rerun when power is restored. It is likely the airflow switch will remain closed after the start of the outage because the momentum of the blower impeller and motor is sufficient to maintain substantial air flow through the duct for a time. Thus, when the operation sequence restarts, if the outage is sufficiently short the closed airflow switch will be treated by systems which now sense the initial condition of the airflow switch, as a malfunction requiring operator intervention. This of course is a real irritant if the "fault" is caused by a momentary power outage for which no operator intervention is necessary.

Accordingly, a control system which merely suspends execution of the startup sequence when the airflow switch is detected as closed at the start of the operation schedule, and upon opening of the airflow switch permits normal startup, will improve the convenience of such systems.

There are a number of references which pertain to management of air flow to a combustion chamber. Perhaps the most relevant of these is U.S. Pat. No. 4,403,942 (Copenhaver) which describes a system for suspending operation if the airflow switch is closed when the demand switch closes. This system is apparently for use with relatively small furnaces of the type simultaneously enabling the blower, fuel, and ignition. Other references which provide background art include U.S. Pat. Nos. 3,263,731 (Hanna et al.); 4,412,328 (Homa); 4,451,226 and 4,451,225 (Landis et al.); 4,695,246 (Beilfuss et al.); 4,518,245 (Mueller et al.); and 4,792,089 (Ballard).

BRIEF DESCRIPTION OF THE INVENTION

The design of control systems in use now in such burner systems can be modified to detect shorted airflow switches and still render these systems able to start up normally if a temporarily closed airflow switch opens at the beginning of the startup sequence by including in the blower relay in addition to the first normally open pairs of contacts for conducting power to the blower, a second normally open pair of contacts in series connection with the blower relay's winding to form a series blower circuit receiving power from the power terminal when the demand control switch is conducting, said second normally open pair of blower relay contacts controlling the supply of power to the blower relay. The invention further includes a safety relay whose winding is energized from the power terminal via the airflow switch. The safety relay has a normally closed contact pair connected to shunt the second normally open pair of blower relay contacts. If the airflow switch is closed then the safety relay is pulled in and this normally closed contact pair is opened preventing the blower relay's winding from being actuated and its blower power contacts from providing power to the blower. If at some later time the airflow switch opens, the blower relay contacts providing blower power close and the burner startup sequence can begin.

Another version of this invention is for use with a burner system of the type having a combustion air duct through which air is drawn by an electrically powered blower to a combustion chamber, said chamber housing a fuel injector providing fuel to the chamber responsive to a control signal supplied to an electrically operated fuel valve and an electrically operated fuel igniter igniting the fuel responsive to a control signal. The burner system further includes (a) an airflow switch within the air duct and conducting electric power from a power terminal to a control system providing the control signals to the valve and igniter according to a prearranged schedule (b) a blower relay having a first pair of contacts connecting the power terminal to the blower, and (c) a demand switch conducting power from the power terminal to start up circuitry providing energizing power to the blower relay winding. The inventive improvement comprises in the startup circuitry a safety relay having (i) a winding which receives from the power terminal, power which flows through the airflow switch and (ii) a pair of normally closed contacts conducting the energizing power from the demand switch to the winding of the blower relay. It can be seen that here, so long as the safety relay winding is energized when the airflow switch is closed, the safety relay contact pair is open and power cannot flow through them to the blower relay winding. Thus, the burner system cannot start so long as the airflow switch is closed. When or if the airflow switch opens, then startup can immediately occur.

Accordingly, one purpose of this invention is to prevent start up of a burner system if the airflow switch is indicating combustion air flow at startup.

Another purpose is to allow normal startup after an airflow switch which indicates normal airflow when startup is requested, ceases to do so.

Yet another purpose of the invention is to allow a system which does not now sense the initial airflow switch condition to be converted easily to one which does sense this initial switch condition and which will also start up in the normal manner if the airflow switch opens after being initially sensed as closed at the beginning of the startup sequence.

DESCRIPTION OF THE PREFERRED EMBODIMENT

Figure 1:
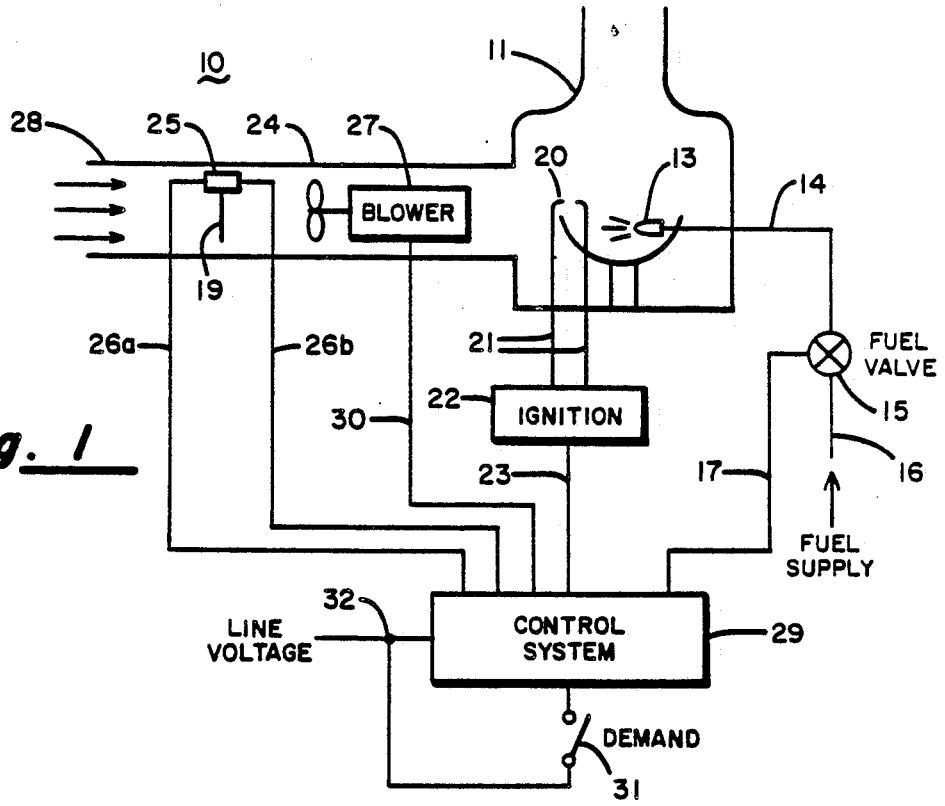
FIG. 1 shows the functional elements of a system which can profitably make use of the instant invention.

The diagram of FIG. 1 shows in sketched format a burner system which may successfully incorporate the invention to be described. There is a combustion air duct 24 having an intake port 28 through which air, shown by the three side-by-side arrows is drawn by a blower 27. The air drawn into duct 24 is supplied to a combustion chamber 11 into which an injector 13 provides fuel. A spark igniter 20 receives high voltage on conductors 21 from an ignition control unit 22 by which fuel within the combustion chamber 11 is ignited. Fuel is supplied to injector 13 through pipe 14, and the flow of fuel into pipe 14 from a pipe 16 is controlled by an electrically controlled fuel valve 15.

The basic operating elements of this burner system are all under the command of a control system 29 which provides control or power on electrical signal paths. The blower 27 receives power for operation on a path 30 from control system 29. Ignition control element 22 receives its operating power on path 23 from control system 29, and control system 29 also supplies the electrical power which causes fuel valve 15 to open or close on path 17.

In the typical situation the burner system will cycle on and off in response to a demand signal controlled by a demand switch 31 which conducts line voltage from a power terminal 32 to control system 29. While demand switch 31 is shown as directly switching line voltage from power terminal 32 to control system 29, it should be understood that it is completely equivalent to use some type of relay or electronic switching device within system 29 and which receives a relatively low voltage demand signal to initiate the operating sequence. The line voltage from terminal 32 is also shown as directly powering control system 29. Further, it may be convenient for line voltage to be supplied directly to the various elements of the burner system such as blower 27, ignition 22, and fuel valve 15 with low voltage control signals supplied on the respective paths 30, 23 and 17 which switch the electrical power to these controlled elements at the appropriate times to cause them to function. Thus, for example, a room thermostat might switch only low voltage which is then used to actuate a relay whose contacts function as demand switch 31.

As mentioned above, it is important for safe and efficient operation that the combustion chamber 11 receive the design rate of air flow. To assure operation of blower 27, the flow of air through duct 24 is sensed in one variation by a switch 25 shown as having a small sail or paddle 19 whose broad surface is perpendicular to air flow in duct 24 and against which this air impinges. As mentioned above, some airflow switch designs operate on pressure differential generated by the moving air stream. The design of switch 25 and sail 19 is such that when airflow velocity reaches a predetermined level, an electrical connection is made within switch 25. By sensing the conductivity between paths **26*a* and 26*b*, control system 29 can determine when the flow of air within duct 24** reaches this predetermined level.

Briefly, the normal startup sequence which occurs within the burner system shown here in FIG. 1 is that first blower 27 runs for a period of time to purge the combustion chamber 11. Once this purge is complete, then an ignition sequence occurs at the end of which the fuel valve 15 will be open with a normal flame burning within chamber 11. Once normal combustion starts, operation continues until the demand has been satisfied, at which point the demand switch 31, typically a thermostat, opens. There is frequently a post combustion purge to remove any possibly combustible gasses remaining in the chamber 11.

Figure 2:
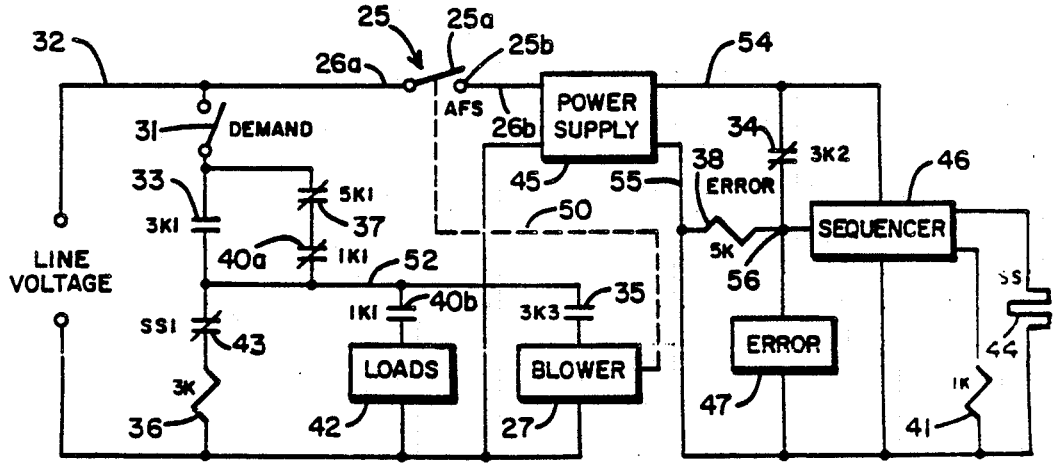
FIG. 2 is a combined circuit and functional block diagram disclosing the invention.

FIG. 2 shows a circuit incorporating a preferred embodiment of the invention, and implemented using mechanical relays. It should be understood that the choice of mechanical relays is strictly arbitrary. There are so-called "solid state relays" having semiconductor elements which function as the individual contacts. It should also be understood that the choice in FIG. 2 of multipole relays is in most cases arbitrary, and that single pole relays which are ganged to reproduce the functions of the multipole relays they replace can in principle be used instead. The reference numbers of FIG. 1 are also used in FIG. 2 for the equivalent elements.

In the circuit of FIG. 2 there is a power source or terminal 32 which supplies electrical power to a demand switch 31 and through path 26*a* to an airflow switch 25. Airflow switch 25 includes a moveable contact 25*a* which is driven into contact with a fixed contact 25*b* responsive to the velocity of the airflow through the combustion air duct 24 exceeding a predetermined value. Demand switch 31 is typically under the control of a thermostat or other load management device.

There are, in FIG. 2, three different relays contributing elements which form a part of this invention: the first is a blower relay designated 3K whose winding 36 controls contact pairs 33, 34 and 35. 3K1 and 3K3 contact pairs 33 and 35 are of the normally open type with contact pair 35 controlling the flow of electric power to blower 27. The winding 36 of the 3K blower relay forms with the normally open 3K1 pair of contacts 33 a series circuit which receives electrical power upon the closing of demand switch 31. The 3K2 contact pair 34 is present to indicate when both it and the airflow switch 25 are closed, the abnormal situation of sensed air flow and a deenergized 3K relay winding 36. This feature provides additional safety of operation, but is not the basic structure of the invention. The 3K2 contacts 34 also provide power for a visual indication of this abnormal condition.

The second relay is a load relay designated 1K whose winding 41 controls the state of a normally closed 1K1 pair of contacts 40*a* and a pair of normally open contacts 40*b* also designated as contact pair 1K1. A control signal from sequencer 46 energizes winding 41. Contact pairs 40*a* and 40*b* have the same designation because of their common connection at conductor 52, so that when contact pair 40*a* is closed, contact pair 40*b* is open and vice versa. This is a safety related design which makes the unsafe condition where contacts 40*a* and contacts 40*b* are both closed very unlikely. The third of these relays is a safety relay 5K whose winding 38 controls a single pair of normally closed safety contacts 37, whose designation 5K1 identifies the contact pair 37 as being part of the 5K relay.

During normal startup, demand switch 31 closes and applies power through the 5K1 pair of contacts 37 which with the 1K1 pair of safety contacts 40*a* form a series safety circuit which shunts the 3K1 pair of contacts 33 to energize the winding 36 of the 3K blower relay. Since both contact pairs 37 and 40*a* are normally closed, the series safety circuit conducts and 3K relay winding 36 is energized. This causes the 3K1 and 3K3 contact pairs 33 and 35 to close. With 3K1 contact pair 33 closed and supplying current to winding 36, the 3K blower relay thus becomes self holding at this point. With winding 36 energized, the 3K3 pair of contacts 35 close as well and blower 27 receives power. As the blower 27 comes up to speed, air flow impinging on the sail controls the position of switch contact 25*a*, as indicated by dotted line 50, and causes moveable contact 25*a* to form electrical connection with contact 25*b*. There are similar contacts operated by pressure differential in another common kind of airflow switch. Closing of switch 25 applies power through path 26*b* to a power supply 45 whose output is typically a low voltage on paths 54 and 55 suitable for operating semiconductor logic devices. Initially, while switch 25 is still open because blower 27 is not yet up to speed, since no power is supplied to power supply 45, the winding 38 of the 5K safety relay is de-energized and contacts 37 thus remain closed.

As blower 27 comes up to speed, switch 25 closes and power is fed to power supply 45. Since the 3K blower relay winding 36 is energized, contact pair 34 is open and no power is applied to circuit point 56. Therefore, winding 38 of the 5K relay remains deenergized, its normally closed 5K1 contact pair remains closed, and no error indication is provided by the error indicator element 47. With switch 25 closed and power available on paths 54 and 55 from power supply 45, sequencer 46 starts its purge, ignition, and firing operations. The ignition and firing operations are powered by the energizing of the 1K load relay winding 41 which closes the pair of contacts 40*b* energizing the ignition and fuel valve loads (ignition/fuel assembly) symbolized as loads element 42. The common contact carrier for contact pairs 40*a* and 40*b* assures that when 1K load relay winding 41 is energized and contact pair 40*b* closes, that contact pair 40*a* must open.

If at some point blower 27 loses power under normal circumstances airflow switch 25 will open and no power will be fed to supply 45. This de-energizes the 1K load relay 41 and power is removed from load element 42 by virtue of 1K1 contact pair 40*b* opening, thus immediately shutting fuel valve 15 shown in FIG. 1.

Consider next the abnormal situation where switch 25 is closed when demand switch 31 closes. Power fed to power supply 45 has energized power supply 45 and because blower relay winding 36 is de-energized, current can flow through the normally closed 3K2 contact pair 34 to energize the 5K safety relay's winding 38. With winding 38 energized, the 5K1 normally closed contact pair 37 is open, and with both contact pairs 37 and 33 open, the 3K blower relay winding 36 cannot be energized. In addition the voltage provided by the connection to point 56, prevents sequencer 46 from beginning the startup sequence.

In this way, as long as the 5K safety relay winding 38 is energized, it is not possible to start the burner startup sequence. If at some later time switch 25 opens, then the 5K safety relay winding 38 is de-energized and the 5K1 normally closed contacts close, completing the safety circuit shunt path across the 3K1 contact pair 33, energizing winding 36 and allowing normal startup. Note that this normal startup occurs without operator intervention. When both airflow switch 25 and 3K2 contact pair 34 are closed, an error signal occurs at point 56. This energizes an error indicator 47 and provides a signal to sequencer 46 specifying the fault condition. Whatever the reason for this abnormal condition, sequencer 46 responds by not beginning its startup sequence.

It should be noted that the 5K safety relay winding 38 may be located anywhere it can be energized when switch 25 is closed and de-energized when switch 25 is open. For example, winding 38 may be located across the input terminals of power supply 45, completely independent of the operation of power supply 45.

Although not part of the invention, the reader should note the manually resettable safety switch whose control element 44 receives signals from sequencer 46. When faults are detected for any reason (such as loss of flame) which requires operator intervention, sequencer 46 deenergizes the 1K relay winding 41 which opens contact pairs (not shown) controlling the various operating functions of the burner, as well as energizing safety switch control element 44 causing the safety switch contacts 43 to open. Opening of contacts 43 de-energizes winding 36 and power to the blower 25 ceases because contacts 35 then open. Such safety switches are required by the various safety laboratories and safety agencies. The point to be noted here is that a temporary failure of airflow switch 25 arising from it being closed when demand switch 31 is closed does not cause the safety switch element 44 to trip and necessitate operator intervention. At the same time, safety is not compromised in the slightest.

Having thus described my invention, what I wish to claim by letters patent is:

1. In a burner system control of whose operation is powered by electric power supplied from a power terminal, said system having a blower for providing combustion air through a duct to combustion chamber, an ignition/fuel assembly for controlling fuel flow to the combustion chamber and ignition of the fuel, a demand control switch supplying power from the power terminal, and a load relay having a first pair of normally open load contacts for providing power to the ignition/fuel assembly responsive to a control signal; and having a control system receiving power from the demand control switch including (i) an airflow switch in the duct conducting responsive to airflow in the duct, said airflow switch having one contact connected to the power terminal;

(ii) a load sequencer receiving power from the power terminal when the airflow switch conducts and supplying the control signal to the load relay responsive to receiving power; and a blower relay having a first normally open pair of contacts controlling the supply of power to the blower, an improvement to the control system for conditioning burner operation on designed-for operation of the airflow switch, comprising (a) in the blower relay, a second normally open pair of contacts in series connection with the blower relay's winding to form a series blower relay circuit receiving power from the power terminal when the demand control switch is conducting; and (b) a safety relay having (i) a normally closed pair of contacts forming a first series safety circuit connected to shunt the blower relay's second normally open pair of contacts, and (ii) a winding connected to receive power which flows through the airflow switch.

2. The control system of claim 1, wherein the load relay has a normally closed pair of contacts in series connection with the safety relay contacts to form the first series safety circuit, and whenever the load relay's normally open pair of contacts and the load relay's normally closed pair of contacts each have a contact on a common contact carrier.

3. The control system of claim 1, including in the blower relay, a normally closed pair of contacts in series connection with said safety relay's winding to form a second series safety circuit, said second series safety circuit connected to the airflow switch to receive power from the power terminal when the airflow switch is conducting, whereby said safety relay's normally closed contacts are held open when the airflow switch is closed and the blower relay winding is de-energized.

4. The control system of claim 3, further comprising an error indicator providing an error indication responsive to power applied to the safety relay's winding.

5. The control system of claim 1, wherein the improvement further comprises in the load relay a second normally closed pair of contacts forming by series connection with said safety relay's contact pair, the first series safety circuit.

6. In a burner system of the type having a combustion air duct through which air is drawn by an electrically powered blower to a combustion chamber, said chamber housing a fuel injector providing fuel to the chamber responsive to a control signal supplied to an electrically operated fuel valve and an electrically operated fuel igniter igniting the fuel responsive to a control signal, said burner system including (a) an airflow switch within the air duct and conducting electric power from a power terminal to a control system providing the control signals to the valve and igniter according to a prearranged schedule, (b) a blower relay having a first pair of contacts for connecting the power terminal to the blower, and (c) a demand switch conducting power from the power terminal to startup circuitry providing energizing power to the blower relay winding, wherein the improvement comprises in the startup circuitry a safety relay having (i) a winding which receives from the power terminal, power which flows through the airflow switch and (ii) a pair of normally closed contacts conducting the energizing power, from the demand switch to the winding of the blower relay.

7. The burner system of claim 6, further comprising in the blower relay a second pair of normally open contacts in series connection with the blower relay winding and supplying power t o the relay winding from the demand switch, said second blower relay contact pair in parallel connection with the safety relay contact pair.

8. The burner system of claim 7, further comprising in the control system a load relay having a normally open pair of contacts through which flows when closed, power for the valve and igniter control signals, and wherein the improvement further comprises in the load relay a normally closed pair of contacts in series connection with the safety relay contacts and forming therewith a series circuit of relay contacts through which flows power to the blower relay's winding during startup.

9. The burner system of claim 8, wherein the series circuit of relay contacts is in parallel connection with the second blower relay contact pair.

10. The burner system of claim 7, wherein the improvement further comprises in the blower relay a third, normally closed pair of contacts, controlling power to the safety relay's winding.

11. The burner system of claim 6, wherein the blower relay further comprises a second pair of normally open contacts on the blower relay in series connection with the blower relay winding and supplying power to the relay winding from the demand switch, wherein the improvement further comprises between said second pair of normally open blower relay contacts and said pair of safety relay contacts, conductors connecting each of said safety relay contacts to a different one of said second pair of normally open blower relay contacts to shunt said second pair of normally open blower relay contacts with said pair of safety relay contacts.

* * * * *

UNITED STATES PATENT AND TRADEMARK OFFICE

CERTIFICATE OF CORRECTION

PATENT NO. : 4,992,040

DATED : February 12, 1991

INVENTOR(S) : JAMES S. WARREN

It is certified that error appears in the above-identified patent and that said Letters Patent is hereby corrected as shown below:

Column 7, line 54, cancel "whenever" and substitute --wherein--.

Column 8, line 29, cancel "power," and substitute --power--.

Column 8, line 35, cancel "t o" and substitute --to--.

Signed and Sealed this

Eighteenth Day of August, 1992

*Attest:*

DOUGLAS B. COMER

*Attesting Officer*

*Acting Commissioner of Patents and Trademarks*